US005694783A

United States Patent [19]

Bartlett

[11] Patent Number: 5,694,783

[45] Date of Patent: Dec. 9, 1997

[54] VAPOR COMPRESSION REFRIGERATION SYSTEM

[76] Inventor: Matthew T. Bartlett, 4200 Squire Ct., Grapevine, Tex. 76106

[21] Appl. No.: 329,542

[22] Filed: Oct. 26, 1994

(Under 37 CFR 1.47)

[51] Int. Cl.[6] ..... F25B 41/00

[52] U.S. Cl. ..... 62/211; 62/223; 62/225; 62/503

[58] Field of Search ..... 62/511, 503, 509, 62/222, 223, 224, 225, 210, 211

[56] References Cited

U.S. PATENT DOCUMENTS

| | | | |
|---|---|---|---|
| 2,241,086 | 5/1941 | Gould | 62/224 X |
| 3,003,333 | 10/1961 | Lysen | 62/511 X |
| 3,638,447 | 2/1972 | Abe | 62/222 |
| 4,768,348 | 9/1988 | Noguchi | 62/223 X |
| 5,222,378 | 6/1993 | Chuan | 62/503 X |
| 5,233,841 | 8/1993 | Jyrek | 62/223 X |

*Primary Examiner*—Harry B. Tanner
*Attorney, Agent, or Firm*—Morgan & Finnegan, L.L.P.

[57] ABSTRACT

The invention relates to a vapor compression refrigeration system for cooling air, particularly for use in automobiles, having a closed circuit for refrigerant fluid incorporating an expansion device in the form of an orifice tube supplying expanded refrigerant fluid to an evaporator for cooling the air, wherein the system comprises electrical heating means such as a resistive wire winding or film resistor to supply heat to the refrigerant fluid within the orifice tube, and control means for controlling the heating means so as to achieve desired mass flow rates of the expanded fluid in the evaporator. The control means may operate in response to signals from a pressure sensor downstream of the evaporator and from further sensors sensing the temperature and speed of the air to be cooled as it enters the evaporator.

4 Claims, 2 Drawing Sheets

VAPOR COMPRESSION REFRIGERATION SYSTEM

FIELD OF THE INVENTION

This invention relates to vapor compression refrigeration systems for cooling air, particularly for use in automobiles, to cool the air supplied to the interior of the automobile.

DESCRIPTION OF THE PRIOR ART

Such refrigeration systems normally have a closed circuit for refrigerant fluid comprising a compressor, a condenser receiving compressed refrigerant fluid in the vapor state from said compressor, an expansion device receiving high pressure refrigerant fluid in the liquid state from said condenser and adapted to permit said fluid to expand to reduce the pressure therein, an evaporator receiving expanded fluid from said expansion device and acting as a heat exchanger to effect cooling of air, which passes through the evaporator in a separate air passage, and connecting means for returning said fluid in the vapor state from said evaporator to said compressor. The portion of the closed circuit from the compressor to the expansion device is known as the high pressure side of the system, while the portion from the expansion device back to the compressor is known as the low pressure side.

A simple known type of expansion device is an "orifice tube", which is a tube with a fairly large ratio of length to inside diameter, typically greater than 10:1. The designer attempts to size the tube to accommodate the desired mass flow of refrigerant fluid, but it has proved difficult to provide for the full range of varying mass flows required in practice. Furthermore, the system can be slow to regain equilibrium after any change in the major operating parameters (compressor speed, load, vehicle ram air cooling airflow over the condenser, etc) and can prove sensitive to the level of the charge of refrigerant fluid in the system.

It will be understood that the load on the system depends on the temperature and humidity of the air passing through the evaporator as compared with the temperature and humidity desired by the occupant(s) of the automobile. The load is proportional to the temperature and humidity of the outside air and to the rate of flow of such air through the evaporator. In general, this rate of flow can be adjusted by the operator by means of a variable-speed blower. High load conditions, i.e. high temperature and humidity, will require more cooling and a higher rate of heat exchange in the evaporator, which in turn means a higher mass flow rate of the refrigerant fluid.

In operation, as the compressed refrigerant fluid received from the condenser in the liquid state passes through the orifice tube, the drop in pressure in the fluid causes a small proportion of the fluid to "flash" into bubbles of vapor. Since this vapor has a much lower density than the liquid, the velocity of flow of the vapor necessary to achieve a given mass flow rate is much higher and the pressure drop versus mass flow rate characteristic is also much higher, so the result of increased "flash" is to reduce the mass flow of refrigerant fluid. The amount of "flash" and the location of the bubbles of vapor thus formed along the length of the orifice tube are a function of the temperature of the refrigerant liquid as it enters the tube. This temperature depends on the cooling effected at the condenser, which in turn depends on the level of the charge of refrigerant fluid circulating in the system at the time. The level of the charge circulating varies with the load on the system, excess charge under low load conditions being normally stored in an accumulator in the low pressure side of the circuit. In such low load conditions, the restriction of flow caused by "flash" can prevent effective control of the cooling of the air in prior art systems.

Under high load conditions, when the pressure in the high pressure side of the circuit is higher, and particularly in conditions of low vehicle speed and little ram air cooling flow over the condenser, the orifice tube tends to pass too much refrigerant liquid, which causes the liquid to arrive at the evaporator with higher pressure and lower temperature, so that the evaporator cannot function efficiently. The system does not therefore provide effective cooling at low vehicle speeds or when the vehicle engine is idling. The size of the orifice tube has hitherto had to be chosen as a compromise between that which would pass an appropriate flow of refrigerant fluid under high load conditions and that which would enable effective control of the phase change (liquid to vapor) cooling to be effected under low load conditions.

SUMMARY OF THE INVENTION

According to the present invention, in a vapor compression refrigeration system for cooling air, having a closed circuit for refrigerant fluid, said closed circuit comprising a compressor, a condenser receiving compressed refrigerant fluid from said compressor, an orifice tube receiving said compressed fluid from said condenser and adapted to permit said fluid to expand to reduce the pressure therein, an evaporator receiving expanded fluid from said orifice tube and acting as a heat exchanger to effect cooling of said air, which passes through the evaporator in a separate air passage, and connecting means for returning said fluid from said evaporator to said compressor, the system further comprises electrical heating means whereby heat can be supplied to said refrigerant fluid within said orifice tube, and control means adapted to control the heating means so as to achieve desired mass flow rates of the expanded fluid in the evaporator.

By means of the invention, the "flash" in the orifice tube can be controlled by application of heat by the electrical heating means, so as to control the mass flow rate of the refrigerant fluid through the orifice tube to match the particular operating conditions. The size of the tube can thus be chosen to permit effective control of the cooling under low load conditions, by controlled production of "flash" in the tube. Under high load conditions the mass flow rate of the refrigerant fluid should be quite high, though without increasing the pressure in the fluid at the evaporator. If the compressor is being driven at an adequate speed, that will prevent this pressure from increasing. If the compressor speed is not adequate, e.g. when the automobile is idling, the control means of the invention can be used to restrict the mass flow through the orifice tube, again by controlled production of "flash", to keep the refrigerant pressure at the evaporator down to that required for effective cooling, even under low speed/idle conditions.

The electrical heating means may, for example, be a resistive wire winding, or a film resistor, disposed around the orifice tube over at least a part of its length.

The system preferably also comprises a pressure sensor producing a signal in dependence on the pressure in the refrigerant circuit between the evaporator and the compressor, the control means being responsive to said signal to control the electrical heating means to maintain the pressure in said refrigerant fluid in the evaporator above that at which the temperature of the refrigerant fluid would fall low enough to cause ice to form in the air passage of the evaporator.

Preferably the system further comprises an accumulator in the closed refrigerant circuit, between said evaporator and said compressor, said pressure sensor being arranged to sense the pressure in said accumulator.

In a more sophisticated embodiment of the invention, the system further comprises a blower to force the air to be cooled through said evaporator, an electric motor driving said blower, a motor speed sensor adapted to sense the speed of said motor, and a temperature sensor adapted to measure the temperature of the air entering the evaporator, the control means being responsive to signals derived from said motor speed sensor and said temperature sensor in addition to said signal from said pressure sensor.

The system may further comprise a combined receiver and accumulator having two compartments, a first said compartment being in the refrigerant circuit between the condenser and the orifice tube and a second said compartment in thermal contact with the first compartment and disposed in the refrigerant circuit between the evaporator and the compressor.

DETAILED DESCRIPTION OF THE INVENTION

Figure 1:
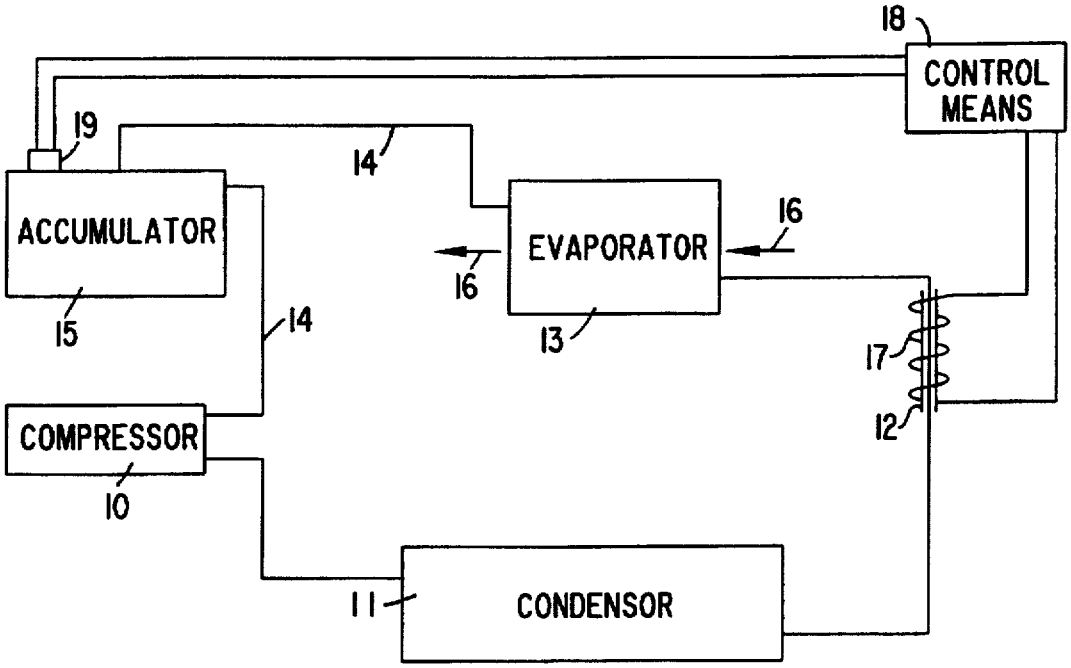
FIG. 1 is a diagrammatic representation of a first embodiment of a refrigeration system according to the invention.

In a first embodiment of the invention, illustrated in FIG. 1, the refrigeration system consists essentially of a closed refrigerant fluid circuit comprising a compressor 10, a condenser 11 receiving compressed refrigerant fluid in the vapor state from the compressor 10 and adapted to cause the compressed fluid to condense into the liquid state and to be simultaneously cooled, e.g. by ram air cooling flow over the condenser, an expansion device in the form of an orifice tube 12 which receives the compressed and condensed fluid from the condenser 11 and permits the fluid to expand to reduce the pressure therein, an evaporator 13 receiving the expanded fluid from the orifice tube 12 and a connecting line 14 which returns the fluid (in the vapor state) from the evaporator 13 to the compressor 10 via an accumulator 15.

The portion of the closed circuit from the compressor 10 to the orifice tube 12 is the high pressure side of the circuit, while the portion from the orifice tube 12 back to the compressor 10 is the low pressure side.

The evaporator 13 acts as a heat exchanger to effect cooling of the air which passes through the evaporator in a separate air passage to a space, such as the interior of an automobile, which is to be cooled. The air flow is indicated diagrammatically by arrows 16.

In accordance with the invention, the orifice tube 12 is provided with electrical heating means, shown by way of example as a resistive wire winding 17 around at least part of the length of the tube 12, connected to control means 18. The control means 18 is connected to a pressure sensor 19 in the accumulator 15 so as to control the supply of heating current to the winding 17 in dependence on the pressure in the refrigerant fluid in the low pressure side of the closed circuit. The control means 18 is preferably set so as to cause the heating winding 17 to provide sufficient heat to the refrigerant fluid within the orifice tube 12 to cause a degree of "flash" which will maintain the pressure in the low pressure side of the refrigerant circuit at a value just above that which would cause the evaporator to produce ice in the air passage of the evaporator.

Figure 2:
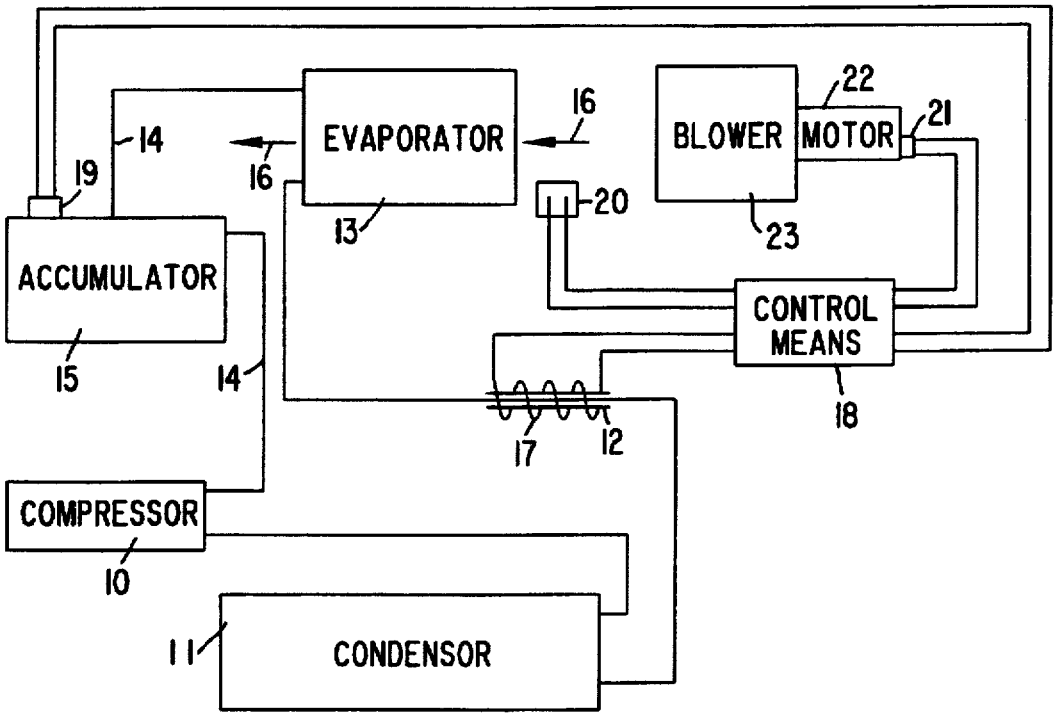
FIG. 2 is a similar representation of a second, more sophisticated, embodiment of the invention.

The second embodiment of the invention, illustrated in FIG. 2, comprises all of the integers 10 to 19 referred to in connection with FIG. 1. It also includes an inlet air temperature sensor 20 for sensing the temperature of the air to be cooled as it enters the air passage through the evaporator 13, and a speed sensor 21 in the form of a voltage sensor connected to the electrical supply to an electric motor 22 which drives a fan or blower 23 which forces the air to be cooled through the evaporator 13. The sensors 20, 21 are connected to the control means 18 so as to feed it with signals dependent on the temperature and speed of the air to be cooled as it enters the evaporator 13. The controlled pressure of the refrigerant fluid in the evaporator can thus be varied to reflect the greater risk of icing in the air passage at lower air speeds and the lesser risk at higher air speeds.

Figure 3:
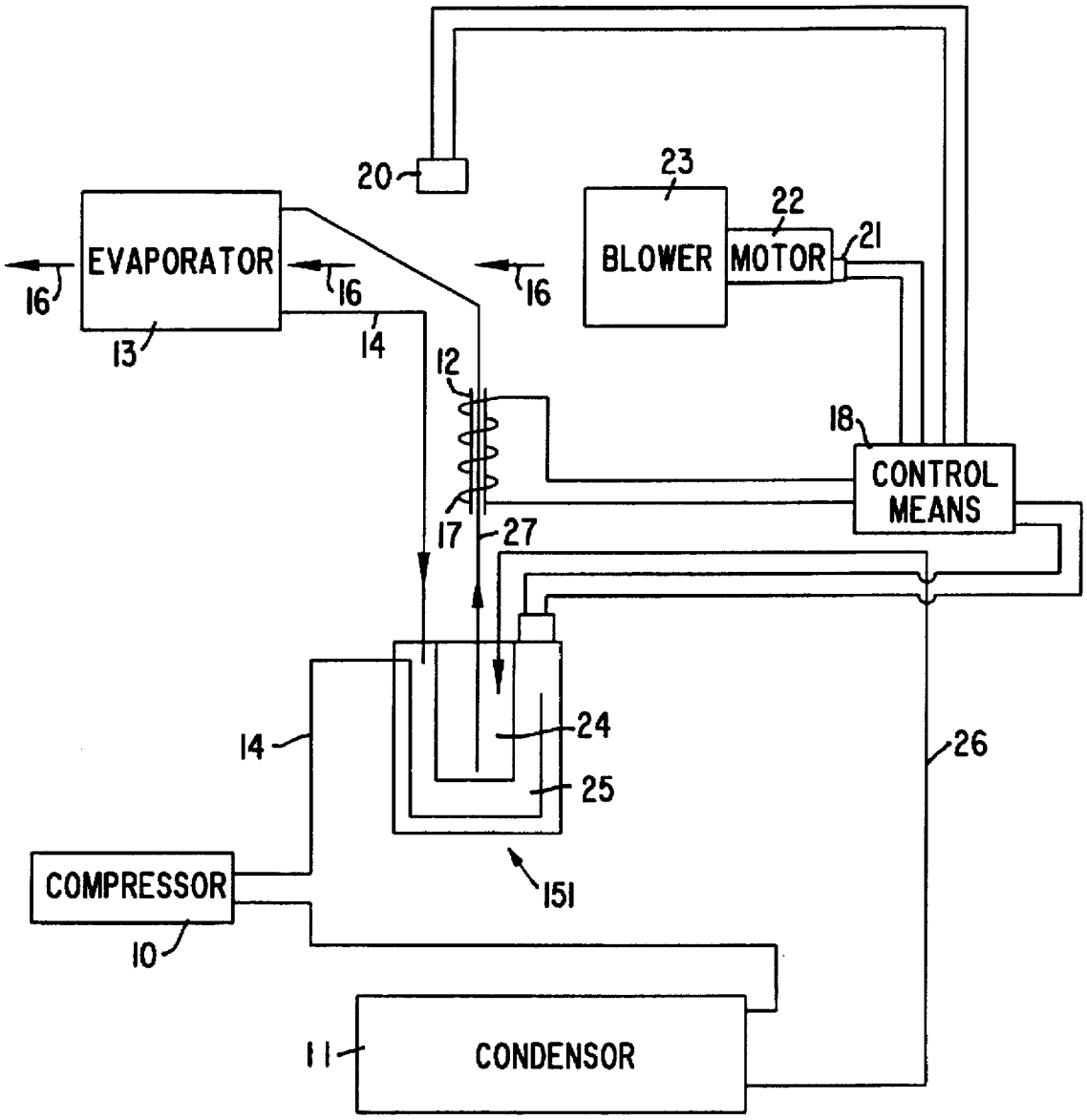
FIG. 3 is a similar representation of a third, yet more sophisticated, embodiment.

The third and preferred embodiment, illustrated in FIG. 3, comprises all the integers 10 to 23 of FIG. 2, except that the simple accumulator 15 of FIGS. 1 and 2 is replaced by a combined receiver and accumulator 151 having two compartments 24, 25. The first compartment 24 receives the compressed and condensed refrigerant liquid from the condenser 11 through line 26 and supplies such liquid to the orifice tube 12 through line 27. The second compartment 25 is in thermal contact with the first compartment 24 and receives the expanded and evaporated vapor from the evaporator 13 and returns it to the compressor 10 via line 14. The first compartment 24 acts as an accumulator to contain excess refrigerant charge and separates liquid from gas on the high pressure side of the circuit while the second compartment 25 serves to cool the refrigerant vapor received from the evaporator 13 on the low pressure side and to return it to the compressor through the line 14.

While the invention has been described with reference to particular embodiments thereof, it will be understood that various modifications may be made without departing from the spirit and scope of the invention, e.g. by the use of other types of heating means for imparting heat to the refrigerant fluid in the orifice tube.

I claim:

1. A vapor compression refrigeration system for cooling air, having a closed circuit for refrigerant fluid, said closed circuit comprising:

a compressor;

a condenser receiving compressed refrigerant fluid from said compressor;

an orifice tube receiving said compressed fluid from said condenser and adapted to permit said fluid to expand to reduce the pressure therein;

an evaporator receiving expanded fluid from said orifice tube and acting as a heat exchanger to effect cooling of said air, which passes through the evaporator in a separate air passage; and connecting means for returning said fluid from said evaporator to said compressor;

wherein the system further comprises electrical heating means whereby heat can be supplied to said refrigerant fluid within said orifice tube, control means adapted to control the heating means so as to achieve desired mass flow rates of the expanded fluid in the evaporator, and a pressure sensor producing a signal in dependence on the pressure in the refrigerant circuit between the evaporator and the compressor, the control means being responsive to said signal to control the electrical heating means to maintain the pressure in said refrigerant fluid in the evaporator above that at which the temperature of the refrigerant fluid would fall low enough to cause ice to form in the air passage of the evaporator.

2. A refrigeration system according to claim 1 further comprising an accumulator in the closed refrigerant circuit, between said evaporator and said compressor, said pressure sensor being arranged to sense the pressure in said accumulator.

3. A refrigeration system according to claim 1 further comprising a blower to force the air to be cooled through said evaporator, an electric motor driving said blower, a motor speed sensor adapted to sense the speed of said motor, and a temperature sensor adapted to measure the temperature of the air entering the evaporator, the control means being responsive to signals derived from said motor speed sensor and said temperature sensor in addition to said signal from said pressure sensor.

4. A refrigeration system according to claim 1 further comprising a combined receiver and accumulator having two compartments, a first said compartment being in the refrigerant circuit between the condenser and the orifice tube and a second said compartment in thermal contact with the first compartment and disposed in the refrigerant circuit between the evaporator and the compressor.

* * * * *